United States Patent [19]

DeVale et al.

[11] Patent Number: 4,807,887

[45] Date of Patent: Feb. 28, 1989

[54] MISSED HIT AND PLAYER PROXIMITY DETECTION SYSTEM FOR ELECTRONIC PROJECTILE GAME

[75] Inventors: Donald P. DeVale, Sycamore; Douglas W. Adams, DeKalb; Robert W. Van Naarden, Hinkley, all of Ill.

[73] Assignee: Industrial Design Electronic Assoc., Inc., Sycamore, Ill.

[21] Appl. No.: 105,997

[22] Filed: Oct. 1, 1987

Related U.S. Application Data

[63] Continuation of Ser. No. 793,647, Oct. 3, 1985, abandoned.

[51] Int. Cl.[4] ..... F41J 5/00

[52] U.S. Cl. ..... 273/372; 340/552

[58] Field of Search ..... 273/371, 372; 340/552, 340/553, 554

[56] References Cited

U.S. PATENT DOCUMENTS

| | | | |
|---|---|---|---|
| 2,783,047 | 2/1957 | Faxen | 273/102.2 |
| 2,916,289 | 12/1959 | Zito | 273/102.2 |
| 2,926,015 | 2/1960 | Edrich | 273/102.2 |
| 2,939,706 | 6/1960 | Skaredoff | 273/372 |
| 3,047,723 | 7/1962 | Knapp | 250/222 |
| 3,252,705 | 5/1966 | Cornberg | 273/54 |
| 3,622,957 | 11/1971 | Libengood | 367/93 |
| 3,678,495 | 7/1972 | Gilbert | 340/323 |
| 4,129,299 | 12/1978 | Busch | 273/102.2 |
| 4,222,564 | 9/1980 | Allen et al. | 273/369 |
| 4,361,330 | 11/1982 | Scharer | 273/372 |

*Primary Examiner*—Leo P. Picard

*Attorney, Agent, or Firm*—Learman & McCulloch

[57] ABSTRACT

A novel missed-hit detection and player proximity detection system for an electronic, automatically scored projectile target game apparatus wherein the scoring system thereof is automatically deactivated whenever a player comes within a proscribed distance range from the game and wherein the impact of a projectile which misses the target, yet strikes the front of the game registers as a non-scoring "missed-hit" and is deducted from the number of remaining throws in that round.

12 Claims, 2 Drawing Sheets

MISSED HIT AND PLAYER PROXIMITY DETECTION SYSTEM FOR ELECTRONIC PROJECTILE GAME

This is a continuation of co-pending application Ser. No. 793,647 filed on Oct. 3, 1985 now abandoned.

BACKGROUND OF THE INVENTION

The present invention relates in general to electronic projectile games and in particular to a missed-hit detection and player proximity detection system for an electronic, automatically scored projectile target game apparatus wherein a preselected number of projectiles are thrown by the users of said game at a target portion in order to activate scoring therein.

While projectile target games employing moving segments to close electronic switches and thereby generate scoring signals have been previously used, few if any have addressed the problem of darts or the like, which miss the target portion of the game and are therefore not scored, but likewise are not detected as having been thrown, thereby enabling the player to have what constitutes a "free throw". Similarly, such automatic scoring projectile games have failed to adequately address the problem caused by players which approach the target portion while the scoring system is in an activated mode and either intentionally or otherwise, touch the target so as to generate a false score.

It is thus an object of the present invention to provide a player proximity detection system which will detect the presence of a player within a proscribed distance range from the front of the game and automatically deactivate the scoring system, thereof so as to prevent any false scores.

It is further and object of the present invention to provide a "missed-hit" detection system for detecting and counting as a non-scoring throw, any projectile or dart, which misses the target, yet strikes the front of the game.

It is also an object of the present invention to provide a system which not only automatically deactivates the scoring system whenever a player comes within the proscribed range, but also automatically and immediately reactivates the scoring system and renders the game otherwise ready to use, as soon as that player retreats behind that proscribed range so as to obviate the need for pushing of reset buttons and accompanying delays in play before the game is once again ready to accept projectiles from the players.

These and other objects and advantages of the present invention will be demonstrated by the following specification.

SUMMARY OF THE INVENTION

The invention comprises a missed-hit detection and player proximity detection system for an electronic, automatically scored projectile target game apparatus, wherein a preselected number of projectiles are thrown by the users of the game at a target, in order to activate a scoring mechanism and obtain a visual score read out. The invention comprises a cabinet which encloses the game apparatus. A projectile impact surface is provided along the front wall of the cabinet, having a front face portion as well as a target portion. The front face portion is positioned so as to substantially surround the target portion and thereby provide a missed-hit impact area for at least a portion of the projectiles which fail to hit the target. Also provided are a scoring system which is operably and electronically associated with the target so as to detect and indicate the impact of any projectiles which strike the projectile impact surface. Also included are the central control system which is also operably and electronically associated with the scoring system and serves to compute the scores generated, display those scores and deactivate the scoring system when desired or needed.

The invention can further comprise a proximity detection system operably and electronically associated with the control system, so as to deactivate the scoring means whenever one or more players approach the cabinet within a proscribed distance therefrom, when the game is capable of accepting darts.

The invention can further alternatively include a missed-hit detection system which is operably and electronically associated with the projectile impact surface, so as to detect and register the impact of any projectiles which miss the target and impact or hit instead against the front face portion of the cabinet. The missed-hit detection system is also operably and electronically associated with the scoring system, so as to count any projectiles impacting upon the front face of the cabinet, as one of the preselected number of projectiles allowed to be thrown per round of the game.

The control system of the present invention can further include a cumulative score retention system operably and electronically associated with the projectile impact surface, as well as the scoring system so as to be capable of cumulatively storing and displaying a numerical score based upon the impacts of the projectiles upon the target. The cumulative score retention system can also further include a system of reducing the number of remaining projectiles in the round, from the initial preselected amount, upon impact of any projectile upon the projectile impact surface, regardless of whether that projectile strikes the target, or misses and strikes the front face surrounding the target instead.

The front face portion of the preferred embodiment comprises a substantially flat, vertical plate operably affixed and secured to the front of the cabinet. Hence, upon impact of that front face portion by a projectile, a signal is emitted.

The missed-hit detection means of the present invention further can include an impact signal receiver operably and electronically associated with the projectile impact surface of a cabinet. The impact signal receiver is activated by the signal emitted by the front face portion upon impact by a projectile. The impact receiver is also operably and electronically associated with the control system so as to indicate one of the projectiles as having been thrown, whenever the impact signal receiver is activated.

The impact signal receiver further comprises a microphonic system operably and electronically associated with the front face so as to receive the emitted impact signal from the front face upon impact of a projectile thereon. The impact signal receiver further includes a signal filter operably and electronically associated with the microphonic system so as to filter out extraneous, ambient signals. In the preferred embodiment, the microphonic system is mounted substantially behind the front face portion in an abutting fashion.

The proximity detection system of the preferred embodiment, further includes a proximity signal generator operably and electronically associated with the control system, and further being operably affixed to the cabinet so as to generate a signal radiating substantially outwardly from the cabinet and striking any objects proximate thereto and then being reflected back towards the cabinet. Also provided is a proximity signal receiver operably and electronically associated with the proximity signal generator so as to receive the reflected signal and compute the time interval between the original generated signal and the reflected signal in the form of analog output. The proximity signal receiver is also operably and electronically associated with the control system so as to use that distance output to determine whether the object or person within the predetermined proscribed distance from the cabinet.

In the preferred embodiment, the aforementioned microphonic system comprises a crystal microphone operably mounted behind the front face of the projectile impact surface so as to receive and electronically transmit any impact signal to the signal filter. In addition, in the preferred embodiment the signal filter comprises a high-pass operational type filter circuit interposed between the microphonic system and the control system so as to filter out any extraneous ambient signals, thereby preventing such extraneous ambient signals from activating the control system.

Likewise, in the preferred embodiment the substantially flat vertical plate of the front face of the projectile impact surface is made of a plexi-glass like material so as to emit a distinct sound to serve as the impact signal upon impact by a projectile. Also, in the preferred embodiment, the proximity signal generator and receiver comprises an ultrasonic transducer which emits regular pulses of sound serving as the radiating signal.

The proximity signal receiver further includes electronic analog to digital conversion circuitry which converts the distance output to digital form prior to its receipt by the control system.

DETAILED DESCRIPTION OF THE DRAWINGS

Figure 3:
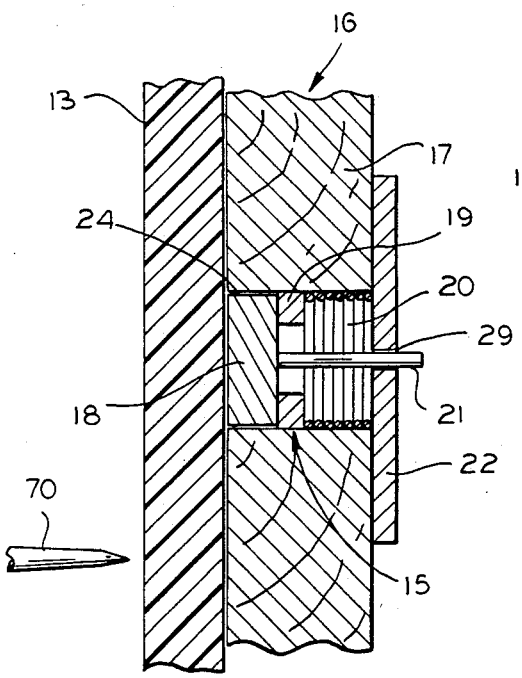
FIG. 3 is a cut-away, side cross-sectional view showing in greater detail how the missed-hit detector is mounted within upper cabinet portion.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

In this preferred embodiment, the game apparatus 10 is a computerized electronic, automatically scored dart game of the type described in DeVale et al., U.S. Pat. No. 4,516,781, but the scope of the present invention should not be taken as limited exclusively to that particular type of game.

Figure 1:
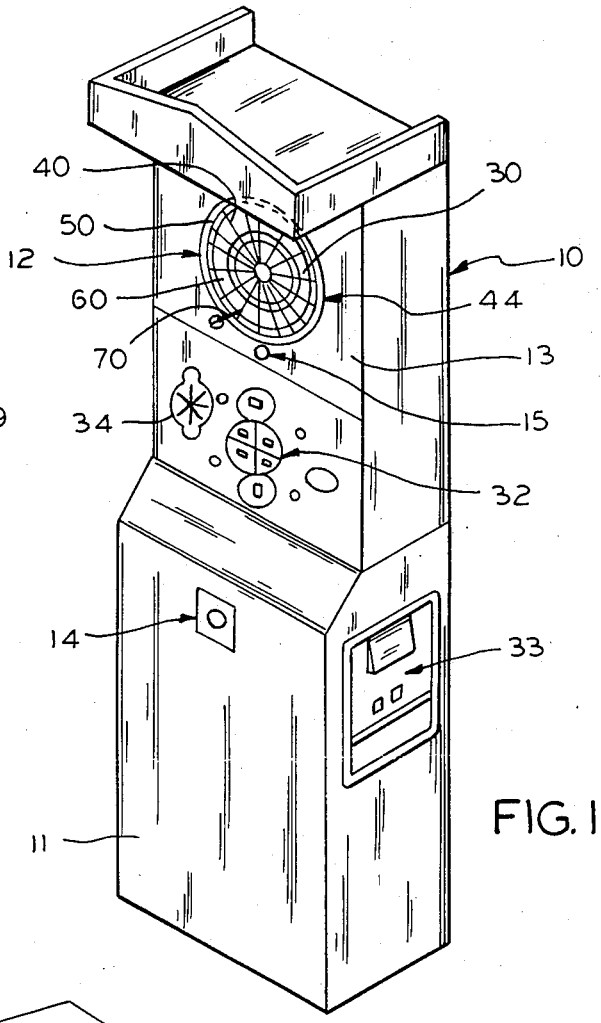
FIG. 1 is a perspective view of the automatically scored projectile target game apparatus illustrating in particular, its cabinetry, target portion, front face portion, display indicia, missed-hit detector, proximity detector and switches.

The preferred embodiment of the present invention, an automatically scored projectile target game apparatus 10 (hereinafter referred to as "game apparatus 10") employing a missed-hit detection system 15 and a player proximity detection system 14, is illustrated in various views in FIGS. 1 through 5. FIG. 1 illustrates game apparatus 10 including cabinet means 11, scoring means 12, and front face portion 13 and target portion 30 of projectile impact means 44. Front face portion 13 serves as an impact area for one or more projectiles 70 that miss target segment 30, referred to herein as "missed-hits." Also shown in phantom in FIG. 1, is missed-hit detection means 15 mounted just behind front face portion 13, in the preferred embodiment. Proximity detection means 14 is shown mounted on the front of cabinet 11, proximate the middle thereof. In the preferred embodiment, proximity detection means 14 is mounted on the outside of cabinet 11 and covered with a fabric or metallic screen. Likewise shown on the front of cabinet 11 is score display means 32 including numbers and lights which reflect both the numerical scores and the events which transpire during the playing of game apparatus 10, such as "game over", which player's turn it is to play, how many rounds remain and how many throws remain in the round.

Figure 4:
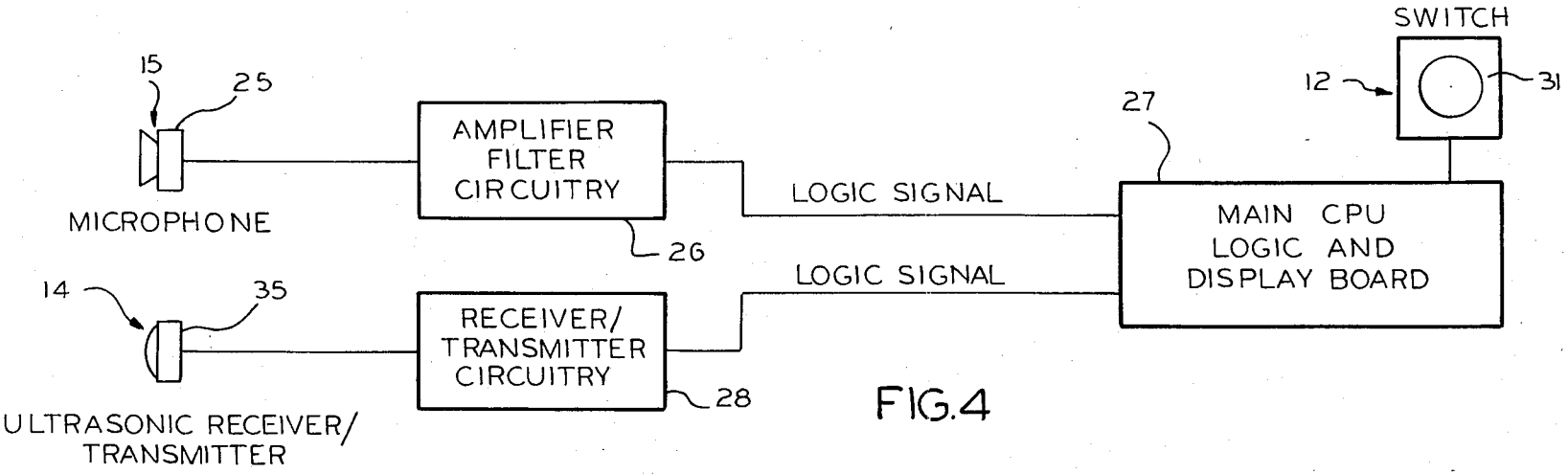
FIG. 4 is an overhead schematic view showing the operation and cooperation of the missed-hit detection system, player proximity detection system, scoring system and control system.

FIG. 1 depicting the preferred embodiment, shows target portion means 30 of projectile impact means 34 as being a dart board target comprising a plurality of radial ribs 40 and radial dividers 50. Impact of one or more projectiles 70 (in the preferred embodiment a dart), upon one of the segments 60 of dart board target 30 results in activation of matrix switch 31 and in turn, electronic activation of central processing unit or control means 27 (as shown in FIG. 4), so as to result in scoring, which after computation by control means 27 is visually displayed as a numerical amount on display 32. Game activation controls 33 are provided on the side of cabinet 11 and game selection controls 34 are provided on the front side thereof, in the preferred embodiment.

Figure 2:
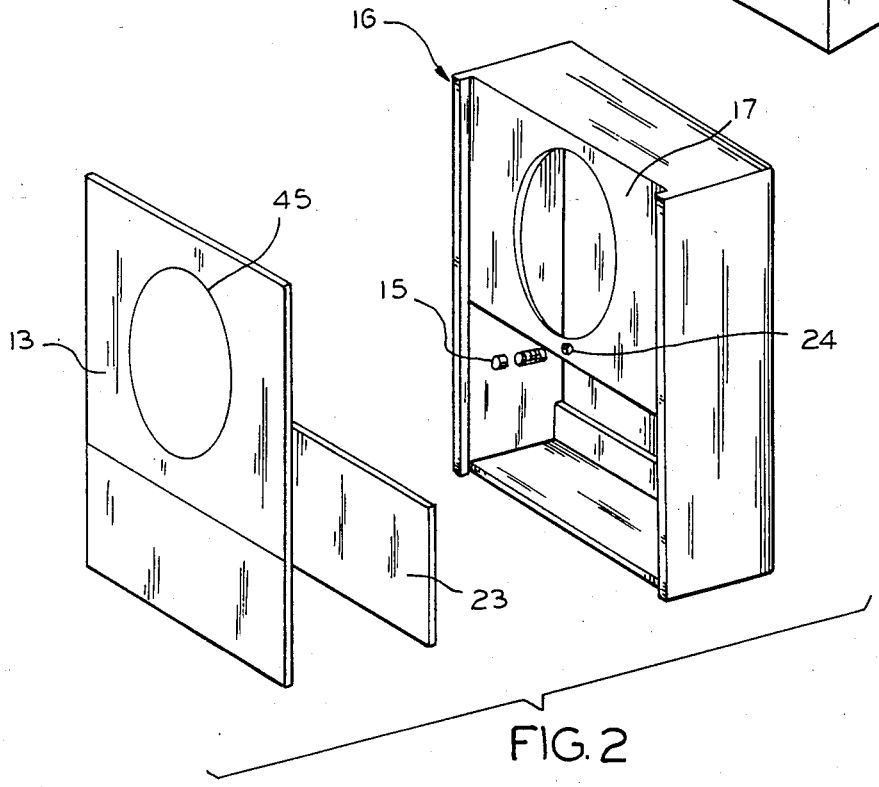
FIG. 2 is an exploded perspective view of the upper cabinet portion showing how the missed-hit detector is mounted behind the front face portion.

FIGS. 2 and 3 illustrate the manner in which missed-hit detection means 15 is mounted within upper portion 16 of cabinet 11. In particular, missed-hit detection means 15 is mounted within aperture 24 formed within target carrying wall 17. As further shown in FIG. 2, front face portion 13, fits over missed-hit detection means 15 and abuts target carrying wall 17, with panel 23 inserted between front face portion 13 and upper cabinet portion 16 when assembled. As shown in FIG. 2, front face portion 13 consists of a flat, vertical plexiglass sheet or plate with cut-out portion 45 shaped to accommodate and surround the periphery of target portion 30 and thereby fully expose the frontal surface area of target portion 30 for impact by projectiles 70 and corresponding activation of scoring means 12. Front face portion 13 emits a characteristic signal in the form of vibration and/or sound upon impact by a projectile 70.

FIG. 3 shows in greater detail how missed-hit detection means 15 is mounted within cabinet upper portion 16. Specifically, in the preferred embodiment, crystal microphone 18 having connection cord 21 extending therefrom, is received within aperture 24 of target supporting wall 17, and is positioned so as to be flush against the back of front face 13. Microphone 18 is maintained in its position up against front face 13, by spring loaded spacer 15 and spring 20. In the preferred embodiment, microphone 18 is of the crystal type having a sensitivity range of between 60 cycles and 20 kilocycles. Spring 20 is interposed between spacer 19 and mounting bracket 22, which is securely affixed to the back of wall 17, by screws or the like. Bracket is provided with aperture 29 to enable cord 21 to pass therethrough and thereby electronically carry the signals received by microphone 18 of microphonic means 25 to amplifier/filter circuitry or signal filtering means 26. Also shown in FIG. 3 is the point or tip of projectile 70 striking front face 13 as it would when a projectile, (or in the case of the preferred embodiment a dart,) misses the target portion 30 and instead strikes front face 13 so as to constitute a "missed-hit".

FIG. 4 schematically displays the operation and electronic connection and cooperation of missed-hit detector means 15, proximity detector means 14 and scoring means 12 of the preferred embodiment with control means 27, though the scope of the present invention should not be taken as limited solely to a system where missed-hit detection system 15 and proximity detection system 14 are both present in a single construction. Indeed, the situations where either the missed-hit detection system 15 or proximity detection system 14 are employed independently of each other are likewise within the scope of the present invention. In the preferred embodiment, control means 27 possesses cumulative score retention means electronically connected to the projectile impact means 44 and scoring means 12 so as to cumulatively store and display a numerical score based upon the impacts of projectiles 70 upon target portion 30 as well as to reduce the number of remaining projectiles remaining in the round prior to changing players, from the initial preselected amount, whenever a projectile 70 strikes target portion 30 or front face portion 13.

Figure 5:
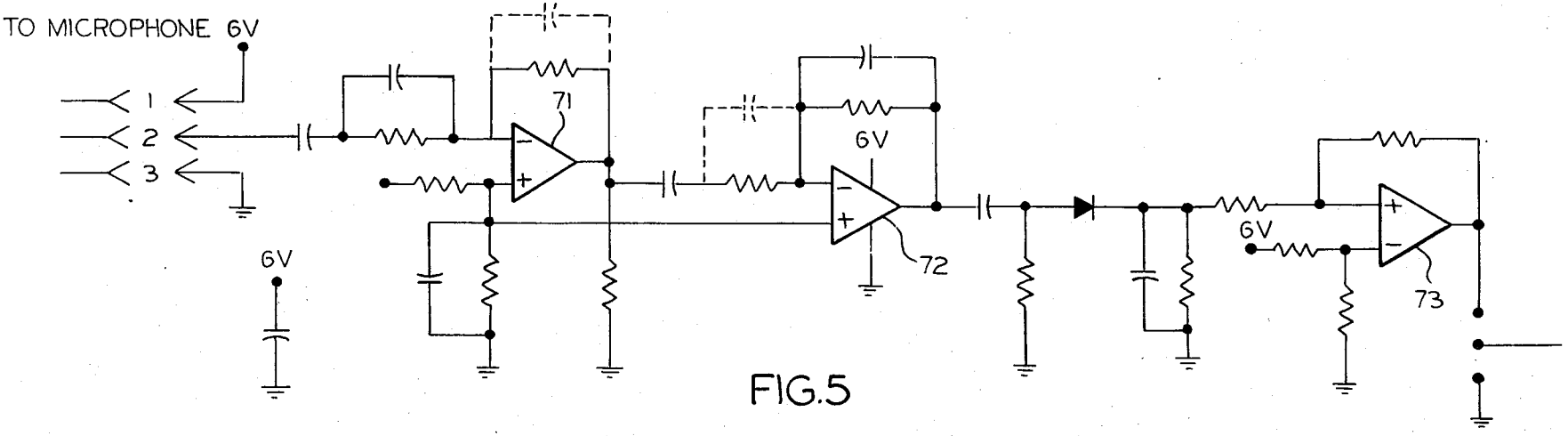
FIG. 5 is an electronic schematic diagram of the signal filtering portion of the missed-hit detector.

FIG. 5 provides an electronic schematic drawing of signal filtering means 26 which in the preferred embodiment consists of a high pass operational type filter circuit. In particular, operational amplifiers 71, 72 and 73 are electronically connected so as to enable any ambient sound of a frequency, lower than approximately 9–11 kilocycles, (the usual frequency of the impact signal of a dart 70 impacting upon plexiglass front plate 13,) to be filtered out, thereby preventing any extraneous sounds, such as those commonly present in the somewhat noisy surroundings where the game 10 is being used, from being electronically misread by control means 27 as a thrown, "missed hit" dart 70.

In operation, in the preferred embodiment, when game apparatus 10 is in an activated position, a thrown projectile 70 which strikes a segment 60 on target portion 30 causes an electronic signal to be sent by matrix switch 31 of scoring means 12 to control means or central processing unit nd circuitry 27, to which it is operably and electronically connected, which in turn causes a visual display of the numerical score generated thereby, and deduction of one of the throws remaining in the round on score display means 32, in a manner previously described in U.S. Pat. No. 4,516,781. In the preferred embodiment, control means 27 employs an 8031-type microprocessor which continuously scans the switch matrix 31 for the impact of a dart 70 on target portion 30. If a thrown projectile misses target portion 30, but instead strikes plexiglass front face portion 13, a distinctive impact signal is generated which includes a characteristic sound having a frequency in the range of approximately 9–11 kilocycles.

Commonly, in other projectile game apparata of this type, such a "missed hit" (which fails to strike target portion 30 and register a score) would not be counted as one of the predetermined number of throws per round, thereby providing the user of the game with an unintended "free throw", instead of properly scoring that "miss" of the target portion 30 as a score of "0".

However, in the preferred embodiment, the aforementioned impact signal of a projectile 70 impacting upon front face portion 13 is detected by impact signal receiver means and microphonic means 25. After passing through signal filtering means 26, to ensure that the signal picked up by microphone means 25 is truly that of the impact of a dart 70 upon front face portion 13, and not mere ambient noise, the impact signal electronically activates the control means 27, containing the main C.P.U., logic and display visual board circuitry, to reduce the number of throws remaining in the round by one. If by some chance, though not likely, two projectiles simultaneously strike a target segment 60 and front face plate 13, only the dart striking the segment 60 will be scored. An alternative embodiment could be employed whereby a vibration sensor could be used instead of microphonic means 15 to detect the impact of a projectile 70 on front face portion 13.

The proximity detection means 14 operates in the following way to prevent unauthorized approach of game 10 and falsely scoring of target portion 30, in the preferred embodiment. Ultrasonic receiver/transmitter 35, comprising the proximity signal generation and proximity signal receiving means, is an ultrasonic transducer which generates sound pulses of a frequency of approximately 50 kilohertz which radiate outward from the front of cabinet 11, whenever game apparatus 10 is activated and all of the preselected number of darts 70 have not yet been thrown. Other embodiments could employ other forms of signal generators. When such radiating signal strikes any objects such as one or more persons, positioned out in front of cabinet 11, the signal is reflected back towards cabinet 11 and is received by ultrasonic receiver/transmitter 35. Receiver/transmitter circuitry 28 of the proximity signal receiving means, which is operably and electronically connected to receiver/transmitter 35, then computes the time difference between the original radiating signal and the reflected signal in analog output form, as a measure of the distance of the persons from the game apparatus 10. Receiver/transmitter circuitry 28 further includes means operably and electronically connected thereto, to convert such analog output into digital form prior to reaching control means 8. The distance output is then electronically relayed to control means 28 and in particular the main C.P.U., which immediately deactivates scoring means 12, if said person or persons are within a predetermined, selectable distance range, usually a zone approximately 2–3 feet outward from the front of cabinet means 11. Accordingly, unauthorized tampering with the target portion 30 and scoring means 12 to obtain a false score is prevented. In the preferred embodiment, once such persons retreat from the proscribed proximity zone, the game 10 and scoring means 12 are automatically reactivated by control means 27. The above-described proximity detection means 14 can also be set to deactivate the game 10 and/or scoring means 12 whenever an individual approaches the cabinet 11 within the proscribed proximity zone, regardless of whether any darts 70 remain to be thrown in that round.

Another feature of the present device is that control means 27 automatically deactivates the scoring means 12 and changes players on the score retention system and score display after the registered impacts of the preselected number of darts 70 in a round, against either target portion 30 or front face portion 13, (usually comprising 3 throws,) thereby obviating the need, as in prior devices, to push a re-set or ready button once darts 70 are removed and any corresponding delay and the scoring means 12 is ready to accept the next round from another player.

The control means 27 of the present invention also includes cumulative score retention means operably and electronically associated with the projectile impact means 44 and the scoring means 12 so as to cumulatively store and display a numerical score based upon the impacts of darts 70 upon the target, as well as having the capability of reducing the number of remaining projectiles for which a score will be allowed to be registered in that round of throws.

While the foregoing presents one specific embodiment of the present invention, it is understood that said embodiment is presented by way of example only, and is not intended to limit the invention. It is expected that others will perceive variations which, while different from the foregoing, do not depart from the spirit and scope of the invention as herein described and claimed.

What is claimed is:

1. A missed-hit detection system for an electronic, automatically scored projectile target game apparatus wherein a selected number of projectiles are thrown by the users of said game at a target portion means in order to activate scoring means therein, said system comprising:

cabinet means enclosing said game apparatus and having a front wall;

said cabinet means having projectile impact means positioned along said front wall;

said projectile impact means having a front face portion means and said target portion means including hit detection means for detecting and registering only the impact of any of said projectiles on said target portion means;

said front face portion means being positioned so as to substantially surround said target portion means and provide a missed-hit impact area for at least a portion of the projectiles which fail to impact upon said target portion means;

missed-hit detection means independent of said hit detection means operably and electronically associated with said projectile impact means, so as to detect and register only the impact of any projectiles which miss said target portion means and impact instead upon said front face portion;

scoring means operably and electronically associated with said target portion means and said missed-hit detection means so as to detect and count said preselected number of thrown projectiles and indicate the impact of said projectiles that impact upon said projectile impact means; and control means operably and electronically associated with said scoring means so as to compute scores generated by said scoring means, display said score and deactivate said scoring means when desired.

2. The invention according to claim 1 wherein said apparatus further comprises proximity detection means operably and electronically associated with said control means so as to deactivate said scoring means whenever one or more persons approach said cabinet means within a proscribed distance therefrom.

3. The invention according to claim 2 wherein said proximity detection means further includes:

proximity signal generation means operably and electronically associated with said control means;

said proximity signal generation means being operably affixed to said cabinet means so as to generate a signal radiating substantially outwardly from said cabinet means and striking any objects proximate to said cabinet means and thereby being reflected back towards said cabinet means;

proximity signal receiving means operably and electronically associated with said proximity signal generation means so as to receive said reflected signal and compute the time interval between said generated signal and said reflected signal, in the form of analog output; and said proximity signal receiving means further being operably and electronically associated with said control means so as to use said output to determine whether said object is within said predetermined distance from said cabinet means.

4. The invention according to claim 3 wherein said proximity signal generating means and proximity signal receiving means comprise an ultrasonic transducer which emits regular pulses of sound serving as said radiating signal.

5. The invention according to claim 4 wherein said proximity signal receiving means further includes electronic analog to digital conversion circuitry which converts said output to digital form, prior to its receipt by said control means.

6. The invention according to claim 1 wherein said control means further includes:

cumulative score retention means operably and electronically associated with said projectile impact means and said scoring means so as to cumulatively store and display a numerical score based upon said impacts of projectiles upon said target portion means; and said cumulative score retention means further including means to reduce the number of remaining projectiles, from said initial preselected amount, upon impact of any projectile upon said projectile impact means.

7. The invention according to claim 1 wherein said front face portion of said projectile impact means comprises:

a substantially flat, vertical plate operably affixed to the front of said cabinet means; and said front face portion means serving to emit a signal upon impact by said projectiles.

8. The invention according to claim 7 wherein said missed-hit detection means further includes:

impact signal receiver means operably and electronically associated with said projectile impact means;

said impact signal receiver means being activated by said signal emitted by said front face portion means upon impact; and said impact receiver means being further operably and electronically associated with said control means so as to indicate one of said projectiles as having been thrown, when said impact signal receiver means is so activated.

9. The invention according to claim 8 wherein said impact signal receiver means comprises:

microphonic means operably and electronically associated with said front face portion means so as to receive said emitted signal from said front face portion means upon impact of a projectile thereon;

said impact signal receiver means further including signal filtering means operably and electronically associated with said microphonic means so as to filter out extraneous, ambient signals; and said microphonic means being mounted substantially behind said front face portion means in an abutting fashion.

10. The invention according to claim 9 wherein said microphonic means comprises a crystal microphone operably mounted behind said front face portion of said projectile impact means so as to receive and electronically transmit said impact signal to said signal filtering means.

11. The invention according to claim 7 wherein said signal filtering means comprises a high-pass operational type filter circuit interposed between said microphonic means and said control means so as to filter out extraneous ambient signals, thereby preventing said extraneous ambient signals from activating said control means.

12. The invention according to claim 7 wherein said substantially flat vertical plate is of a material such as plexiglass, so as to emit a distinct sound serving as said impact signal upon impact by a projectile.

* * * * *